US006083672A

United States Patent [19]

Roefs et al.

[11] Patent Number: 6,083,672

[45] Date of Patent: Jul. 4, 2000

[54] METHOD OF PROCESSING A BLACK-AND-WHITE SILVER HALIDE PHOTOGRAPHIC MATERIAL

[75] Inventors: André Roefs, Herentals; Benedictus Jansen, Geel; Frank Michiels, Arendonk, all of Belgium

[73] Assignee: Agfa-Gevaert, N.V., Mortsel, Belgium

[21] Appl. No.: 09/158,881

[22] Filed: Sep. 23, 1998

[30] Foreign Application Priority Data

Oct. 6, 1997 [EP] European Pat. Off. ..... 97203096

[51] Int. Cl.[7] ..... G03C 5/26

[52] U.S. Cl. ..... 430/440; 430/446; 430/455; 430/963

[58] Field of Search ..... 430/440, 446, 430/455, 963

[56] References Cited

U.S. PATENT DOCUMENTS

| | | | |
|---|---|---|---|
| 5,629,138 | 5/1997 | Faranda et al. | 430/455 |
| 5,707,790 | 1/1998 | Yanagisawa | 430/440 |
| 5,783,379 | 7/1998 | Willems et al. | 430/963 |

FOREIGN PATENT DOCUMENTS

| | | |
|---|---|---|
| 0 679 938 | 11/1995 | European Pat. Off. . |
| 0 679 938 | 3/1996 | European Pat. Off. . |
| 0 786 694 | 7/1997 | European Pat. Off. . |
| 0 789 271 | 8/1997 | European Pat. Off. . |
| 0 793 140 | 9/1997 | European Pat. Off. . |
| 0 809 136 | 11/1997 | European Pat. Off. . |

*Primary Examiner*—Hoa Van Le
*Attorney, Agent, or Firm*—Breiner & Breiner

[57] ABSTRACT

A method of processing an exposed black-and-white silver halide light-sensitive photographic material has been disclosed, said method comprising the steps of developing in a developer solution, followed by fixing in a fixer solution, comprising a hardening agent, preferably a compound providing aluminum ions, and wherein, in running equilibrium conditions, said fixer solution has a pH of at least 4.3, further adding to said fixer a fixer replenisher at a rate of from 0 $ml/m^2$ up to 300 $ml/m^2$; followed by rinsing and drying, wherein rinsing between developing and fixing is excluded and wherein an α-ketocarboxylic acid structure in an amount of from 0 to 3 g per liter is present in the said fixer solution while starting processing or in the said fixer replenisher, characterized in that said developing step is performed in a developer comprising, in an amount of from 5 g up to 100 gram per liter, a developing agent corresponding to the formula (I), a precursor and/or a metal salt thereof given in the detailed description and in the claims hereinafter. Most preferably 1-ascorbic acid, iso-ascorbic acid or (tetramethyl) reductic acid is used as a developing agent.

15 Claims, No Drawings

METHOD OF PROCESSING A BLACK-AND-WHITE SILVER HALIDE PHOTOGRAPHIC MATERIAL

FIELD OF THE INVENTION

The present invention is related with a method of processing a silver halide light-sensitive photographic material without sludge formation in the fixer solution.

BACKGROUND OF THE INVENTION

Hitherto, a considerable reduction in the total processing time of exposed black-and-white silver halide light-sensitive materials, and more particularly of those suited for use in medical diagnosis and in industrial non-destructive testing applications, has been achieved by persisting research leading to improvements on silver halide light-sensitive materials at one hand and processing agents, automatic processing machines and processing cycles on the other hand. In particular, reduction in processing time is very important for radiographic light-sensitive materials for medical use, because in an emergency every second counts for a medicine when a diagnosis should be made urgently in order to start a treatment.

In the case of industrial X-ray sensitive materials for non-destructive testing applications, it is necessary to coat a large amount of silver since the sensitivity of said materials to X-rays largely depends on the silver coverage thereof as direct-X-rays are captured, and consequently a much longer processing time is required for said industrial X-ray sensitive materials opposite to radiographic materials for medical use.

For medical radiographic imaging, rapid processing in an automatic processing machine is popular, and the total photographic processing time "dry-to-dry" ranges from 90 sec. to 3.5 min.

A substantially longer time from 5 min. to 11 min. is required for industrial X-ray sensitive materials. It is clear that under these circumstances, a further reduction in such a "dry-to-dry" processing time is desired.

In order to reduce the total photographic processing time, the processing time in each step, including development, fixing, washing (also called "rinsing") and drying should be shortened. A reduction in development time is generally known to be achieved by enhancing the activity of the developer. Increasing the concentration of the developing agent, pH of the developer solution, development temperature, addition of a developer activating agent (e.g. a hydrazine as in EP-A's 0 679 938 and 0 789 271) etc., in order to enhance the activity of the developer makes the cost of processing rise and/or makes preservation stability of the developer decrease. On the other hand, washing (rinsing) and drying times largely depend upon the thickness and the swelling degree of the coated layers that make part of a light-sensitive silver halide photographic material. Therefore, it is possible to reduce such processing times by previously using a hardener in a sufficient amount in order to increase the cross-linking degree of gelatin. However, the said increase causes a decrease in covering power which in turn requires an increase in silver coverage, in order to compensate for any decrease in sensitivity. Opposite thereto developability decreases and a further decrease in fixing speed is observed, thereby making the total processing cycle become more time-consuming.

In the patent literature EP-A 0 712 037, e.g., illustrates the combined use of an aminopolycarboxylic acid and a polyphosphonic acid sequestering agent in order to prevent aluminum sludging in hardening fixing baths when pH of the fixing solution is raised by an alkaline developer carried over from the developing solution. The fixing solution moreover shows a reduced sulfur dioxide emission because it is able to work at pH values higher than the well-known values within a classical standard pH range of from about 4.0 up to 4.5. Another composition as described in EP-A 0 726 491 makes use of α-ketocarboxylic acid compounds in order to reduce sulfur dioxide emission.

Processing in an automatic roller transport processor wherein processing is carried out without an intermediate washing step between the steps of developing and fixing, has been described, e g., in U.S. Pat. No. 3,545,971. In order to facilitate the use of a roller transport processor, both the developer and the fixer typically contain a hardening agent, with the hardening agent usually being an aldehyde in the developer and an aluminum salt in the fixer. Boric acid is often incorporated in the fixer used in the aforesaid process in order to prevent the formation of sludge resulting from precipitation of aluminum hydroxide when the fixer is contaminated by developer carry-over. Use of boric acid has been described, e.g., in U.S. Pat. No. 4,046,570. The hardening fixer composition described in this patent also contains a 1-hydroxy-alkylidene diphosphonic acid, in which the alkylidene group contains from 2 to 5 carbon a toms in order to retard formation of aluminum hydroxide. The 1-hydroxyalkylidene diphosphonic acid partially or completely replaces boric acid in the hardening fixer composition.

Another method to reduce the precipitation tendency of aluminum hydroxide has been described in Research Disclosure 17549. Therein a combination of a diphosphonic acid, such as a hydroxyalkylidene diphosphonic acid, and an aminopolycarboxylic acid, such as a 1,3-diamino-2-propanol tetraacetic acid, is used in order to process films in a roller transport processor wherein the processing is carried out without an intermediate washing step between the steps of developing and fixing. The tendency of aluminum hydroxide to precipitate in the hardening baths after carry-over of the aluminum salt hardening agent in a stabilizing bath is thereby clearly reduced. The diphosphonic acid and the aminopolycarboxylic acid are effective in the (color) stabilizing bath having a pH in the range from about 6 to about 11 in small concentrations such as amounts of each of about one gram per liter or less.

Japanese Patent Application 05/323 525 describes a black-and-white fixer solution comprising aminopolycarboxylic acids and/or phosphonic acids as chelating agent, preventing the water fur and odor. The fixer composition is substantially free from ammonium ions and substantially free from aluminum hardener, the amount of the hardener being lower than 0.1 mole/l, which is the minimum amount known in the art to give the fixer composition a hardening activity, as has been described e.g. in Research Disclosure 16768 and in U.S. Pat. No. 4,046,570.

In U.S. Pat. No. 5,300,405 a method of processing has been described using an optimized geometry in the dryer section of the processing in order to get suitable physical properties after drying of photographic films fixed in a fixer having a pH greater than 4.6 in running equilibrium conditions. Preferred developers are dihydroxy-benzene type developers, although other developers are not excluded. In that invention, a fixer has been described having a buffering capacity in the range between 0.5 to 0.8 mole/liter of a pH buffer agent, whereas usual fixers contain a pH buffer agent in a concentration of about 0.3 mole/liter.

From the side of the silver halide photographic material measures have been taken as disclosed in U.S. Pat. No. 5,230,993 wherein said material contains a polymer having a cationic site in a fixing solution, in order to improve fixing rate, dye stain and high-speed processing.

In order to further promote the objective of a very short total processing time it is advantageous to employ ammonium thiosulfate as a fixing agent, because it acts more rapidly than its alternatives such as sodium thiosulfate, as has been described in GB 1,290,026. Thus, a particularly desirable fixer is the one which contains ammonium thiosulfate and which is free from boric acid. However, it has been found that in those circumstances a very serious problem of crystal formation occurs. In particular, crystals are deposited from the fixer on the walls of the fixer tank and on the roller assemblies. In addition, the crystalline deposit displays a tendency to absorb additional fixer, thereby resulting in movement of "creep" along processor parts and tank walls. Research Disclosure 18728 discloses a number of agents incorporated in the hardening fixer solution which suppress crystal formation. Useful agents are, for example, aminopolyphosphonic acids, such as diethylenetriaminepenta-methylenephosphonic acid, and aminopolycarboxylic acids, such as 1,3-diamino-2-propanol tetraacetic acid.

EP-A 0 486 909 describes a fixing bath free from ammonium ions containing as a complexing agent, e.g., nitrilodiacetic monopropionic acid, useful in the processing of silver halide photographic materials. The bath exhibits good fixing speed and no deposition.

In praxis the fixer used in U.S. Pat. No. 5,300,405 has a pH value generally controlled at a pH of 4.6 or higher, preferably a pH from 4.6 to 6.0, and still more preferably from pH 4.7 to 5.5 as measured in running equilibrium conditions. Minimized odor thereby escapes from the fixer solution and provides minimized corrosion of the processing equipment and the surrounding environment. Since the fixer has a relatively weak hardening effect, increased drying loads are imposed on the photosensitive material being processed therewith. Even so, that invention makes use of a sophisticated drying process as defined above, accomplishing effective drying while eliminating locally uneven drying and drying marks.

The pH of common fixer solutions is normally in the range from 4.00–4.50, because at a higher pH value, especially more than 5.00, $Al(OH)_3$ becomes precipitated. On the other hand, a lower pH value is correlated with an undesired odor of environmentally unwanted sulfur dioxide due to decomposition of sulfites present in the fixer solution at the said lower pH values.

It should therefore be useful to have a photographic fixer composition showing a reduced tendency to form an aluminum hydroxide precipitate at pH values higher than those of standard fixer compositions as at the said higher pH value an advantageously reduced $SO_2$ emission is highly desirable from an environmental point of view.

OBJECTS OF THE INVENTION

It is a first object of the present invention to provide a method to avoid aluminum sludging in fixing solutions and to provide a method to omit boron compounds in fixers containing aluminum, without a further risk of precipitation of aluminum hydroxide.

It is a second object to provide a method to have highly buffered developing solutions without increased risk of precipitation of aluminum hydroxide in the fixer solution.

It is a further object of the present invention to provide a method to avoid aluminum sludging of hardening fixing solutions, even when the preservation time of the fixing solution becomes very long.

Still a further object of the present invention is to provide an environmentally and toxicologically friendly method of processing without deterioration o f drying properties of films.

Last but not least it is an object of the present invention to provide a fixing solution compatible with the method of processing of the present invention.

SUMMARY OF THE INVENTION

A method of processing an exposed black-and-white silver halide light-sensitive photographic material has been disclosed, said method comprising the steps of developing in a developer solution, followed by fixing in a fixer solution, comprising a hardening agent and wherein, in running equilibrium conditions, said fixer solution has a pH of at least 4.3, further adding to said fixer a fixer replenisher at a rate of from 0 $ml/m^2$ up to 300 $ml/m^2$; said fixing step followed by rinsing and drying, wherein rinsing between developing and fixing is excluded; wherein a compound having an α-ketocarboxylic acid structure in an amount from 0 to 3 g per liter is present in the said fixer solution while starting processing or in the said fixer replenisher; characterized in that said developing step is performed in a developer comprising, in an amount of from 5 g up to 100 gram per liter, a developing agent corresponding to the formula (I), a precursor and/or a metal salt thereof given in the detailed description and in the claims hereinafter. Most preferably 1-ascorbic acid, iso-ascorbic acid or (tetramethyl) reductic acid is used as a developing agent Besides realization of the above mentioned objects by the method having the specific features defined in claim 1, specific features for preferred embodiments of the invention are disclosed in the dependent claims. Further advantages and embodiments of the present invention will become apparent from the following description, followed by the Examples.

DETAILED DESCRIPTION OF THE INVENTION

As is well-known in the processing of photographic materials seasoning of the processing solutions makes their compositions differ from the compositions of solutions added freshly to processing tanks of developer and fixer. Therefore as an efficient measure in order to minimize differences in compositions between start and while running processing, the use of starter solutions is well-known since quite a long time as has e.g. been illustrated in U.S. Pat. No. 3,276,874. More recently in EP-A 0 696 759 a method for processing a black-and-white silver halide photographic material in an automatic processing machine or processor is disclosed, wherein the developer replenisher is used in the form of a concentrated solution or in the form of a solid comprising a dihydroxybenzene or ascorbic or erythorbic acid or derivatives thereof.

A developer replenisher having a higher pH value (in an amount of at least 0.5) than its development starting solution has been described in U.S. Pat. No. 5,503,965. Addition of starter to developer replenisher in order to reduce pH drop to a value of 0.2 or less has further been described in JP-A 05-289254. Starter tablets and chemical compositions thereof have been described in JP-A 04-032839.

Descriptions of processing methods wherein a starter solution is added to the fixing solution can be found in JP-A 06-250350. In JP-A 06-230527 a method for rapid processing a black-and-white silver halide material in an automatic processing machine is disclosed, wherein the fixer replenisher has a higher thiosulfate concentration than the fresh fixer. Addition of a basic starter such as alkali metal hydroxides or carbonates has been described in JP-A 03-068937.

The addition of sulfite salts to the fixer replenisher solution is known in order to compensate for the drop in sulfite concentration and pH decrease due to electrolysis. Electrolysis can proceed for example by passing the fixer around a circulation loop which includes an electrolytic cell. Electrolytic removal of silver also has the benefit of enabling a lower regeneration rate of fixer to be used. This is fully consistent with recent trends to reduce the volume of treatment liquids used in photographic processing. Electrolysis of the fixer solution, known as most efficient method of chemical recovery of the said fixer solution in order to reduce the slow down effect on fixation rate of increasing amounts of silver ions present in the fixer, however makes pH and sulfite ion concentration decrease.

As a consequence a less stable fixer solution is provided, wherein sulfur deposit may tend to occur as has e.g. been described in J.Imag.Techn. Vol. 10 (1984), p. 214 and in Materials Evaluation, April 1991, p. 511.

As an approach of modern technological developments related with rapid processing from the viewpoint of ecology is becoming more and more stringent, a demand for lower replenisher volumes is a normal trade-off. As a consequence differences in compositions between seasoned processing solutions and fresh solutions after throughput of constant amounts of photographic material tend to increase. The said differences are the ultimate factors determining to what extent reduction in replenishing amounts may be carried out.

Problems resulting therefrom are e.g. lack for constant and acceptable sensitometric properties (a "must" with respect to "constant quality" required by the clients), degradation of physical properties (e.g. uneven gloss at the surface of the processed and dried material) and unacceptable odor of the processing solutions.

In order to provide constant sensitometric and physical properties of silver halide photographic materials after rapid processing in solutions, replenished with minimum amounts of the said solutions and in order to specifically minimize the difference between the freshly prepared fixer solution and the fixer solution after seasoning a solution has been proposed as disclosed in EP-A 0851 286. A method of processing in a processor an image-wise exposed light-sensitive silver halide photographic material is proposed therein, comprising the steps of developing in a developing solution and fixing in a fixer solution, characterized in that upon starting of the processing the said fixer solution comprises a mixture of a fixer starter solution and a fixer replenisher solution and in that said fixer solution is replenished with the said fixer replenishing solution.

As a novel element with respect to the methods of processing of light-sensitive silver halide photographic materials it has been found in the present invention that the particular combination of a developer and a fixer containing aluminum, in particular when the pH value of that fixer is increased with respect to the common pH range (4.0 to less than 4.5) wherein said fixer is used at a pH value of at least 4.3, more preferably from 4.6 up to 5.5 and still more preferably from 4.8 up to 5.3, admits the use of a decreased amount of fixer replenisher, wherein even the absence of a fixer replenisher is not excluded, even in the absence at the start of the processing of boron compounds in the said fixer.

Moreover even after seasoning of the processing solutions in running equilibrium state or condition, the same advantages are encountered in that there is no tendency to the formation of sludge in the fixer.

It will become clear from the experiments hereinafter that carry-over of seasoned developer comprising a developing agent according to the general formula (I), a precursor and/or a metal salt thereof, avoids the formation of sludge in the fixer solution, containing at least one compound providing hardening aluminum ions.

The formula (I) corresponds to the chemical structure given hereinafter, (I)

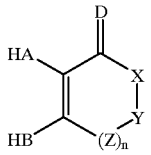

wherein in the formula (I) each of A, B and D independently represents an oxygen atom or $NR^1$;

X represents an oxygen atom, a sulfur atom, $NR^2$; $CR^3R^4$; C═O; $C{=}NR^5$ or C═S;

Y represents an oxygen atom, a sulfur atom, $NR'^2$; $CR'^3R'^4$; C═O; $C{=}NR'^5$ or C═S;

Z represents an oxygen atom, a sulfur atom, $NR''^2$; $CR''^3R''^4$; C═O; $C{=}NR''^5$ or C═S;

n equals 0, 1 or 2;

each of $R^1$ to $R^5$, $R'^2$ to $R'^5$ and $R''^2$ to $R''^5$ independently represents hydrogen, alkyl, aralkyl, hydroxyalkyl, carboxyalkyl, alkenyl, alkynyl, cycloalkyl, cycloalkenyl, aryl or heterocyclyl; and wherein $R^3$ and $R^4$, $R'^3$ and $R'^4$, $Ra^3$ and $R''^4$, may further form a ring together;

and wherein in the case that $X{=}CR^3R^4$ and $Y{=}CR'^3CR'^4$, $R^3$ and $R'^3$ and/or $R^4$ and $R'^4$ may form a ring and in the case that $Y{=}CR'^3R'^4$ and $Z{=}CR''^3CR''^4$ with n=1 or 2, $R^3$ and $R'^3$ and/or $R^4$ and $R'^4$ may form a ring.

In a preferred embodiment in the formula (I) A, B and X each represent an oxygen atom; n=0; Y=CH13 $(CHOH)_m$—$CH_2$—$R^6$ wherein m=1,2,3 or 4 and wherein $R^6$ represents OH for m=1; and H or OH for m=2, 3 or 4. This formula corresponds with (iso)ascorbic acid. As a suitable derivative corresponding to the formula (I), iso-ascorbic acid and 1-ascorbic acid are both preferred.

In another preferred embodiment A and B each represent an oxygen atom; n=O and X and Y each correspond with $C(CH_3)_2$. This formula corresponds with tetramethyl reductic acid.

The compound(s) according to the formula (I) preferably is(are) present in the developer solution in an amount comprised between 1 g and 100 g per liter, although a preferred amount of from 20 up to 50 g per liter is sufficient in many cases.

Examples of reducing precursor compounds have, e.g., been described in WO's 94/3834 and 94/16362, which are both incorporated herein by reference.

It is clear that within the context of this invention ascorbic acid is not merely used in the developer as an antioxidant as, e.g., described in WO 93/12463, in JP-A's 4428673 and 55149936, in GB 1,266,533 and in U.S. Pat Nos. 3,865,591; 4,756,997 and 4,839,259 and in the literature as, e.g., J. Am. Chem. Soc., 60 (1938), p. 99 and p. 2084; 61 (1939), p. 442;

64 (1942), p. 1561, 65 (1943), p. 1489; 66 (1944), p. 700 and 104 (1982), p. 6273.

According to the method of the present invention, said method comprises the step of developing in a developing solution, wherein said solution comprises one or more developing agents. Besides ascorbic acid, reductic acid, stereoisomers or derivatives thereof, normally one or more 1-phenyl-pyrazolidine-3-one or 1-phenyl-pyrazolidine-5-one, commonly known as "phenidone" compound, is(are) present. A preferred phenidone compound used in the method of the present invention is 4,4'-hydroxymethyl-methyl-pyrazolidine-3-one, which is present in amounts of from 0.5 g up to 5 g/liter of developer. Especially if iodide ions are present in the developing solution, said preferred phenidone compound is present in lower amounts as has been disclosed in U.S. Pat. No. 5,296,342.

Developing solutions comprising ascorbic acid and/or derivatives therefrom have e.g. been disclosed in EP-A's 0 731 381, 0 731 382 and 0 732 619.

In a preferred embodiment according to the present invention said developer is substantially free from any polyhydroxybenzene compound, as e.g. hydroquinone, analogues and/or derivatives therefrom.

In another preferred embodiment according to the present invention said developer is substantially free from any hardening agent.

In still another preferred embodiment said developer and/or said fixer solution is(are) free from any boron compound. Although the absence of boron compounds is known to be particularly unfavourable with respect to sludge formation in common processing solutions, its absence is particularly favourable from the point of view of ecology and a suitable solution has therefore been provided therefore by the method of the present invention.

As a consequence of the use of fixer solutions having a higher pH of at least 4.3, preferably of from 4.6 up to 5.5, and still more preferably from 4.8 up to 5.3, the method according to the present invention permits use of lower replenisher amounts and even permits the absence thereof. As a result the further advantage of a lower emission level of sulfur dioxide vapours, thus reducing disagreable smell is observed.

A fixer replenisher, if present, should have a lower pH than the fixer itself in so-called "running equilibrium conditions" in order to compensate for "carry-over" of the alkaline developer to the fixing tank. The pH values in those so-called "running equilibrium conditions" are in the range from 4.6 up to 5.5, and more preferably from 4.8 up to 5.3. This means that at the start of processing said fresh fixer may have a lower pH than 4.6; e.g. in the common range between 4.0 and 4.5. The fixer replenisher should not be extremely low in pH and should preferably be in the pH range from e.g. 4.4 up to 4.9. This pH range makes it unnecessary to separate a part mainly containing a thiosulfate and a part mainly containing an aluminum salt hardener: a single part concentrated replenisher can be used without disadvantages.

In one embodiment of the present invention, the fixer replenisher, if present, is preferably supplied at a rate of from 50 ml/m$^2$ up to 300 ml/m$^2$, more preferably at a rate of from 50 ml/m$^2$ up to 150 ml/m$^2$ and still more preferably from 50 ml/m$^2$ up to 100 ml/m$^2$ in running equilibrium conditions. In this case the term "replenishing equilibrium conditions" refers to the condition attained after replacement of a volume equivalent with three times the total tank volume. In another embodiment wherein no replenisher is used as is the case in batch processing but as is not excluded in the context of the present invention, the term "running equilibrium conditions" refers to the moment the processing solution is exhausted, thus requiring exchange of the said processing solution.

The present invention is advantageously applicable to such a reduced replenishment mode and doesn't exclude the absence of a fixer replenisher, especially when, according to the present invention, pH in the fixer solution in running equilibrium conditions is between a value of from 4.6 up to 5.5 and buffering compounds are present in a concentration of from 0.2 up to 0.8 mole per liter and more preferably in a concentration of from 0.3 up to 0.6 mole per liter. Particularly suitable buffering compounds in the fixer solution are formed by acetic acid and sodium acetate, forming an acetate buffer.

The same applies to the developer solution as in a preferred embodiment according to the present invention pH in said developer solution is buffered between a value of from 9.0 up to 11.0 by buffering compounds having a concentration of from 0.3 up to 1.0 mole/liter and more preferably from 0.3 up to 0.7 mole/liter. Particularly suitable buffering compounds in the developing solution are carbonates as has also been shown in EP-A 0 565 459 wherein the use of ascorbic acid developers with high concentrations of carbonate buffering is illustrated. The high carbonate level provides a high degree of pH buffering and also provides aeration protection via reduced oxygen solubility in the developing solution. Use of highly buffered ascorbic acid developers has been disclosed e.g. in U.S. Pat. No. 5,503,965, wherein the instability of ascorbic acid developers has been tackled not only by the use of highly buffering solutions but in addition by the use of replenisher solutions having a higher pH. The use of developers having a higher buffer capacity however increases the likelihood of aluminum sludging in the fixer, since the pH increase in the fixer solution due to carry-over of alkaline developer will be greater.

As already mentioned the method of the present invention is particularly applicable when a compound having an α-ketocarboxylic acid structure in an amount of from 0 to 3 g per liter is present in the said fixer solution while starting processing, thus in the so-called fresh fixer, or in the said fixer replenisher, if present. Preferred compounds having such a having an α-ketocarboxylic acid structure are e.g. oxalic acid, tartaric acid, citric acid, gluconic acid or derivatives thereof in amounts of not more than 3 g per liter at the start of the processing. More preferably the fixer is free from those compounds at the start of the processing. This should be considered as a particular advantage offered by the method of the present invention, especially from the viewpoint of cost price of the processing solutions, as even without the presence of those compounds the object of the present invention to avoid sludge formation is fully attainable.

For the developer in practizing the method of the present invention, a developer replenisher is preferably supplied at a rate of from 50 ml/m$^2$ up to 300 ml/m$^2$, more preferably at a rate of from 50 ml/m$^2$ up to 150 ml/m$^2$ and still more preferably up to 100 ml/m$^2$. This reduced replenishing rate is particularly preferred when the developing solution is highly buffered as set forth hereinbefore.

As Previously mentioned, the fixer contains a water-soluble aluminum salt as a hardener. Examples of aluminum salt hardeners include aluminium chloride, aluminium sulfate and potassium aluminum. The hardener is preferably added in an amount of from 0.01 to 0.2 mole/liter, more preferably 0.03 to 0.08 mole/liter.

In addition to the above-mentioned components, the fixer contain s as preservatives e.g. sulfites and bisulfites, wherein thanks to the preferred pH working range irritating smell or unagreable odor is avoided to a large extent. Further pH adjusting agents as e.g. sulfuric acid and chelating agents are desired.

Subsequent to the developing and fixing steps, the photosensitive material is processed with washing water or with a stabilizing solution which may be replenished at a rate of up to 3 liters per square meter of the photosensitive material (inclusive of 0, indicating batchwise tank water). This enables processing with water savings, and piping upon installation of the processor becomes unnecessary. Although washing water is commonly used, processing with a stabilizing solution is also acceptable.

Although only one washing tank is used in the illustrated embodiment, any suitable means for reducing the amount of a washing water replenished can be applied to the invention. One such well-known means is a multistage (e.g. two or three stage) counter-flow system. This system accomplishes efficient washing since the photosensitive material after fixation comes into contact with a series of clearer washing water portions, that is, water portions which are less contaminated with the fixer as the photo-sensitive material proceeds forward.

In the case of the washing process with water savings or non-piping washing process, anti-bacterial means is preferably applied to washing water or stabilizing solution. The anti-bacterial means includes irradiation of ultraviolet radiation as disclosed in JP-A 263939/1985; application of a magnetic field as disclosed in JP-A 263940/1985; blowing of ozone as described in Somiya ed., "Ozone Utilising Treatment", Kogai Taisaku Gijutu Doyukai, 1989, the methods disclosed in Japanese Patent Application Nos. 309915/1989 and 208638/1990, the use of ion-exchange resins to purify water as disclosed in JP-A 131632/1986, and anti-bacterial agents as disclosed in JP-A 115154/1987, 153952/1987, 220951/1987 and 209532/1987. Also useful are anti-fungal agents, anti-bacterial agents and surfactants as described in L. E. West, "Water Quality Criteria", Photo. Sci. & Eng., Vol. 9, No. 6 (1965); M. W. Beach, "Microbiological Growths in Motion-Picture Processing", SMPTE Journal, Vol. 85 (1976); R. O. Deegan, "Photo processing Wash Water Biocides", J. Imaging Tech., 10, No. 6 (1984); and JP-A 8542/1982, 58143/1982, 97530/1982, 132146/1982, 157244/1982, 18631/1983, and 105145/1983.

In the washing and stabilizing baths, there may be added in combination with microbiocides, the isothiazolines described in R. T. Kreiman, J. Image, Tech 10(6), 242 (1984), the isothiazolines described in Research Disclosure, Vol. 205, No. 20526 (May 1981), the isothiazolines described in Research Disclosure, Vol. 228, No. 22845 (April 1983), the compounds described in JP-A 209532/1987, and the silver ion releasing agents described in Japanese Patent Application No. 91533/1989. Other useful compounds are described in Horiguchi.Hiroshi, "Bokin Bobai no Kagaku", Sankyn Publishing K. K. 1982, and Nippon Bokin Bobai Society, "Bokin Bobai Gijutu Handbook (Antifungal & Antibacterial Engineering Handbook)", Hakuhodo K.K., 1986.

Where washing is done with a smaller amount of water in the practice of the present invention, it is preferred to place squeeze roller washing tanks as disclosed in JP-A 18350/1988 or to employ a washing arrangement as disclosed in JP-A 143548/1988.

Overflow solution exits from the washing or stabilizing bath as water having any anti-bacterial means applied thereto is replenished with the progress of processing. Part or all of the overflow solution may be used as a processing solution having a fixing function in the preceding step as disclosed in JP-A 235133/1985.

While the photographic silver halide photosensitive material is processed according to the invention in an automatic processor including at least developing, fixing, washing (or stabilizing) and drying steps as mentioned above, the overall process from development to drying should preferably be completed within 90 seconds. More specifically, the time taken from the start point of time when the leading edge of a photosensitive material film or sheet enters the developer, past the fixing, washing (or stabilizing) and drying steps, to the end point of time when the leading edge exits the drying section, which is known as a dry-to-dry time, proceeds within a total processing time of from 30 up to 90 seconds, and more preferably from 35 up to 75 seconds. Comparable desired total processing times have e.g. been set forth in EP-A's 0 678 772, 0 709 730, 0 712 034 and 0 712 036.

Several terms are defined in conjunction with a sequence of successively processing a length or sheet of photosensitive material through a developing tank, a fixing tank, a washing tank, and then a drying section of an automatic processor. "Developing process time" or "developing time" is a duration taken from the point when the leading edge of a photosensitive material is dipped in the developing tank liquid in the processor to the point when it is subsequently dipped in the fixer. "Fixing time" is a duration taken from the point when the leading edge is dipped in the fixing tank liquid to the point when it is dipped in the washing tank liquid (or stabilizer). "Washing time" is a duration when the photosensitive material is dipped in the washing tank liquid. "Drying time" is a duration when the photosensitive material passes through the drying section where hot air at 35° to 100° C., preferably 40° to 80° C., is usually blown.

In order to accomplish rapid processing within 90 seconds on a dry-to-dry basis, the developing time is generally within 30 seconds, preferably within 25 seconds while the developing temperature ranges from 25° to 50° C., preferably from 30° to 40° C. The fixing time generally ranges from 5 to 20 seconds at temperatures of about 20° to 50° C., preferably from 5 to 15 seconds at temperatures of about 30° to 40° C. Within this range, full fixation is done and the sensitising dye can be leached out to such an extent that no residual color is left. For water washing or stabilizing bath, the time generally ranges from 4 to 20 seconds at temperatures of 0° to 50° C., preferably from 4 to 15 seconds at temperatures of 15° to 40° C.

In order to further promote the objective of a very short total processing time, it is advantageous to employ ammonium thiosulfate as fixing agent, because it acts more rapidly than alternative fixing agents such as sodium thiosulfate, as described in GB 1,290,026. Additionally, the fixer contains a sulfite salt to stabilize the thiosulfate against decomposition with respect to time and temperature. Thus, a particularly desirable fixer is one which contains ammonium thiosulfate and a sulfite salt. Research Disclosure No. 15407, February 1977, e.g. discloses a method for reducing the evolution of sulfur dioxide from photographic fixing baths by adding a suitable quantity of a sulfite-complexing agent when preparing the working strength solution. This enables the sulfite concentration in the fixer concentrate to remain at the accepted high level required in order to stabilize the thiosulfate, but, upon dilution, the complexing agent will reduce the sulfate content to a sufficiently low level, that the evolution of sulfur dioxide is minimized. The sulfite-complexing agent may be an aldehyde e.g., glutaraldehyde, ketone, e.g., acetone, or any compound which forms a relatively stable sulfite complex in aqueous solution in the pH range from 3.0 to 6.0. Japanese Patent Application No. 05-119445 describes a fixer for photographic materials containing specified amounts of ammonium thiosulfate and of sodium thiosulfate which do not generate toxic gases during processing. Japanese Patent Application No. 04-019739 describes a solid fixer for silver halide photographic material containing thiosulphate and sulphite and, opposite to the present invention at the start, at least one of citric, tartaric, maleic, succinic and phenyl acetic acids to prevent sulphur dioxide gas generation just as in EP-A 0 726 491 Al mentioned above, wherein use of α-ketocarboxylic acids is described as useful in order to decrease the smell of the fixer solution during processing.

In some cases the bad odors caused by the sulfur dioxide evolution have been reduced by adding specific compounds to the fixer, without reducing the sulfur dioxide evolution itself. In fact, Japanese Patent Application No. 05-313,320 describes a fixing liquid containing thiosulfate in concentrated state and diluted at time of use to prevent bad odors from being given off. In addition, a fixer composition comprising fixing agents, stabilizing, hardening agents and acids, e.g., succinic or maleic acid, has been disclosed in Japanese Patent Application No. 05-127,323.

The apparatus for the processing of photographic material according to the method of the present invention may comprise a plurality of treatment vessels including a developing vessel and a fixing vessel, the apparatus including means for feeding photographic material to be processed along a photographic material path through the developing vessel and the fixing vessel in turn, and an electrolytic cell for removing silver ions from fixer in the fixing vessel.

The treatment vessels may be positioned one above the other in a vertical configuration. In particular, the developing vessel may be positioned above the fixing vessel. If more than one fixing vessel is present the first fixing vessel may in turn be positioned above the second fixing vessel. This configuration is preferred, in order to prevent fixer from entering the developing vessel. However in such an arrangement, a pump will be required to transfer used fixer upwardly into the first fixing vessel. Alternatively, the vessels may be positioned side by side in an essentially horizontal configuration, especially where fixing vessels, if more than one is present, have a cascade relationship.

An electrolytic silver recovery cell may be of known construction. For example, the cell comprises a cylindrical housing fitted with a central anode surrounded by a removable cathode. The housing has inlets and outlets for the liquid to be de-silvered. A glass reference electrode enables control of the de-silvering process, which is carried out either at constant potential, at constant current or according to some other control regime. As the de-silvering process proceeds, silver is deposited and builds up on the cathode. The cathode is periodically replaced. Silver can be recovered from the used cathode in a known manner, and usually the cathode can be re-used. The silver recovery cell may be an electrolysis unit from an "ECORAP" processor (trade mark product from Agfa-Gevaert NV) or a Curix "EOSFIX" electrolysis unit (trade marketed product from Agfa-Gevaert NV). An apparatus for the electrolytic recovery of silver from solutions containing silver is known from EP-A 0 611 838 and from EP-A 0 757 120. In case the fixer is desilvered electrolytically, it may even be possible to use aluminum as (part of the) anode material in the electrolysis unit. Desilvering of the fixer then results in the liberation of aluminum ions due to anodic oxidation, thus providing the hardening component in the fixer.

It is believed that if photographic material is passed directly from the developer into the fixer, the carried-over developer hampers the fixing process, especially when low fixer regeneration is used. This is particularly the case when electrolytic desilvering is used on-line, since this allows very low fixer regeneration rates, since the accumulation of silver in the fixer and the corresponding fixing rate decrease is avoided. Preferably the photographic material is then treated with the first fixer liquid for a period of time less than half that of the fixer treatment time, most preferably less than 25% that of the fixer treatment time. Treatment with the first fixer liquid for a relatively short period of time can most easily be achieved by providing a shorter photographic material transport path through the intermediate treatment liquid, for example by providing the intermediate treatment liquid in an intermediate vessel having a path length less than that of the vessel containing the fixer, thereby enabling the photographic material to pass through the apparatus at a constant speed. One or more fixing vessels in the method of the present invention are regenerated by addition thereto of replenisher solution.

Within the scope of the method of the present invention sheet materials such as (medical and industrial) X-ray film materials, pre-sensitized plates, graphic art films and paper, offset plates, etc., can be processed. Preferably an X-ray film material is processed according to the method of the present invention. Particularly any film for medical diagnostic imaging may be processed, wherein said film may be exposed with a laser directed by digitized data obtained after conversion of information captured by suitable means after exposure to radiation of part of the human body as described e.g. in EP-A 0 794 456 and in the corresponding U.S. Pat. No. 5,712,081 or exposed after conversion of X-rays by one or two intensifying light-emitting screen(s) brought into contact with the said film and wherein said film may comprise cubic and/or tabular silver halide crystals as described e.g. in EP-Applications Nos. 97200590 and 97200591, both filed Mar. 1, 1997 and No. 97202169, filed Jul. 11, 1997.

According to a preferred embodiment in the method of the present invention, the said materials are composed of at least one light-sensitive silver halide emulsion layer comprising emulsion crystals rich in silver chloride. More preferably said emulsion crystals rich in silver chloride are {100} cubic or {111} or {100} tabular crystals.

Preferably said materials are X-ray materials, wherein the said X-ray materials are single-side or double-side coated materials. It is clear that the total processing time wherein the processing cycle is run strongly depends on the amounts of silver coated into the light-sensitive silver halide emulsion layers. According to the present invention the method comprises the steps of developing, fixing, rinsing and drying, wherein the total processing time of these steps is from 30 up to 90 seconds as set forth hereinbefore. A time of 300 seconds is however required for processing of e.g. industrial X-ray films coated with huge amounts of silver as has e.g. been described in EP-A's 0 620 482, 0 620 483, 0 620 484, 0 621 506, 0 622 668 and in 0 698 817.

While the present invention will hereinafter be described in connection with a preferred embodiment thereof, it will be understood that it is not intended to limit the invention to that embodiment. On the contrary, it is intended to cover all alternatives, modifications and equivalents as may be included in the spirit and scope of the invention as defined by the claims.

EXAMPLES

Following developer and fixer compositions ready-for-use were prepared:

| Developer composition A: | |
|---|---|
| potassium sulfite | 63.9 g |
| ethylene diamine tetra acetic acid (tetra-sodium salt) | 2.1 g |
| hydroxyethyl diphosphonic acid (di-sodium salt) | 1.0 g |
| diethylene glycol | 45.9 g |
| potassium carbonate | 30.6 g |
| hydroquinone | 29.25 g |
| methyl benzotriazole (mixture of 4- and 5- derivative) | 90 mg |
| 1-phenyl-5-mercaptotetrazole | 7 mg |
| potassium hydroxide | 54 0 g |
| 1-phenyl-pyrazolidine-3-one | 1.10 g |
| 5-nitro-indazole | 125 mg |
| acetic acid | 8.32 g |
| glutardialdehyde | 4.9 g |
| potassium metabisulfite | 7.5 g |
| Addition of water up to a volume of 1 liter. | |
| pH: 10.25 | |

| Developer composition B: | |
|---|---|
| potassium sulfite | 68.3 g |
| ethylene diamine tetra acetic acid (tetra-sodium salt) | 2.1 g |
| potassium iodide | 13 mg |
| hydroxyethyl diphosphonic acid (di-sodium salt) | 0.5 g |
| diethylene glycol | 27.45 g |
| potassium carbonate | 12.0 g |
| hydroquinone | 28.0 g |
| methyl benzotriazole (mixture of 4- and 5- derivative) | 127 mg |
| 1-phenyl-5-mercaptotetrazole | 9 mg |
| di-natrium tetraborate.10aq. | 1.5 g |
| potassium hydroxide | 8.6 g |
| 1-phenyl-4,4'-hydroxymethyl-methyl pyrazolidine-3-one | 2.33 g |
| Addition of water up to a volume of 1 liter. | |
| pH: 10.35 | |

| Developer composition C: | |
|---|---|
| potassium sulfite | 68.1 g |
| ethylene diamine tetra acetic acid (tetra-sodium salt) | 2.1 g |
| potassium iodide | 13 mg |
| hydroxyethyl diphosphonic acid (di-sodium salt) | 0.5 g |
| potassium carbonate | 63.5 g |
| ascorbic acid | 45.0 g |
| methyl benzotriazole (mixture of 4- and 5- derivative) | 127 mg |
| 1-phenyl-5-mercaptotetrazole | 9 mg |
| di-natrium tetraborate.10aq. | 1.5 g |
| potassium hydroxide | 10.2 g |
| 1-phenyl-4,4'-hydroxymethyl-methyl pyrazolidine-3-one | 2.33 g |
| Addition of water up to a volume of 1 liter. | |
| pH: 10.55 | |

| Developer composition D: | |
|---|---|
| potassium metabisulfite | 23.0 g |
| ethylene diamine tetra acetic acid (tetra-sodium salt) | 2.1 g |
| hydroxyethyl diphosphonic acid (di-sodium salt) | 1.0 g |
| polyethylene glycol 400 | 22.5 g |
| potassium carbonate | 95.6 g |
| sodium isoascorbate.1 aq. | 61.5 g |
| methyl benzotriazole (mixture of 4- and 5- derivative) | 30 mg |
| 1-phenyl-4,4'-hydroxymethyl-methyl pyrazolidine-3-one | 2.0 g |
| boric acid | 15 g |
| Addition of water up to a volume of 1 liter. | |
| pH: 9.65 | |

| Fixer composition A: | |
|---|---|
| ammonium thiosulfate | 138.0 g |
| sodium metabisulfite | 20.0 g |
| sodium acetate.3aq. | 32.5 g |
| acetic acid | 7.8 g |
| aluminum sulfate | 5.4 g |
| Addition of water up to a volume of 1 liter. | |
| pH: 4.90 | |

Unless otherwise stated, fresh solutions of the developers were used for the experiments. In some examples, also oxidized developers were used. These were prepared by exposing the fresh solutions to the ambient air during 14 days.

Example 1

Influence of Time on the Deposition of Aluminum

In the following example, mixtures of developer solutions and of the fixer solution A were made and the appearance of haze and precipitation was followed as a function of time. The compositions of the mixtures are expressed in volume % of developer in the mixture of developer and fixer. Corresponding data are given in the Table 1 hereinafter. Therein "times in hours ("h") after mixing" have been given in the first column for differing "mixture compositions" classified in the following columns, wherein "dev." means "developer"; "sol." means "solution" and "oxid." means "oxidized". Evaluation of the said solutions is expressed as "TRANSP" for "transparent", "SLCL" for "slightly cloudy", "CLOUD" for "cloudy" or "hazy" and "PREC" for "precipitation".

TABLE 1

| Mixture comp. | 12% dev. sol.A | 12% oxid. dev.sol.A | 8% dev. sol. B | 16% dev. sol. B | 20% dev. sol.B |
|---|---|---|---|---|---|
| 0 | TRANSP | TRANSP | TRANS | TRANSP | TRANSP |
| ⅙ h | TRANS | TRANSP | TRANSP | TRANSP | CLOUD |
| 1 h | SLCL | TRANSP | TRANSP | TRANSP | CLOUD |
| 4 h | CLOUD | TRANSP | TRANSP | CLOUD | CLOUD, PREC |
| 16 h | CLOUD, PREC | CLOUD, PREC | TRANSP | CLOUD, PREC | CLOUD, PREC |
| 24 h | CLOUD, PREC | CLOUD, PREC | TRANSP | CLOUD, PREC | CLOUD, PREC |

Appearance of haze and precipitation of aluminum may occur slowly. Depending on the amount of developer in the fixing solution, haziness and precipitation may occur very soon or much later. In practice, it is even observed that the precipitation takes place after days and weeks of incubation.

Example 2

Influence of Replenishing Amounts on the Appearance of Precipitation.

The experiments were performed using a slightly modified Curix 60 automatic developing machine (trademarked product from Agfa Gevaert), using CURIX Ortho HTH film, exposed up to 30% of the total surface.

The developer solution A and the fixer solution A were used. The experiments were performed at standard regeneration rates of 600 ml per square meter of film for the developer. The experiment was performed using the standard regeneration rate for the fixer (750 ml/$m^2$) in one case and without replenishment of the fixer fluid in the other case.

In each experiment 5,25 $m^2$ of film were processed in 5 blocks of 1,05 $m^2$ each. After each block of 1.05 $m^2$ of processing, the fixer solution was visually inspected. After processing 5.25 $m^2$ of film, the fixer was left to stand and was visually inspected again after 24 hours. The results are summarized in the following Table 2.

TABLE 2

| $m^2$ of film processed | Standard fixer replenishment | No fixer replenishment |
|---|---|---|
| 0 | no haze, no precipitation | no haze, precipitation |
| 1.05 | no haze, no precipitation | no haze, no precipitation |
| 2.1 | no haze, no precipitation | haze |
| 3.15 | no haze, no precipitation | haze, slight precipitation |
| 4.2 | no haze, no precipitation | severe precipitation |
| 5.25 | no haze, no precipitation | severe precipitation |
| after 24 hours | no haze, no precipitation | severe precipitation |

If the fixer replenishment is high enough, no precipitation takes place. If the replenishment is too low (or absent), haze (cloudiness) and precipitation start to appear. After processing of about 4 $m^2$, severe precipitation occurs. Since the tank volume of the fixer tank is 1 liter, this corresponds with an equivalent replenisher amount of about 250 ml/$m^2$.

The lower the replenishment figures of the fixer, the higher the relative amount of developer carried over in the fixer solution. Due to the buffering action of the developer, this causes a pH increase and precipitation of aluminum. If more buffering substances are present in the developer, increase of pH in the fixer will be more pronounced.

Example 3

Influence of Buffering of Developer Solution on pH Increase of the Fixer Solution.

A number of mixtures of fresh developing solutions and fixing solution A were made. The pH of the mixtures was measured after a preservation time of 1 hour as given in Table 3 hereinafter.

TABLE 3

| Percentage of developer in mixture | Developer Solution A | Developer Solution B | Developer Solution C | Developer Solution D |
|---|---|---|---|---|
| 4% | 4.88 | 4.78 | 4.92 | 4.94 |
| 8% | 5.08 | 4.95 | 5.16 | 5.17 |
| 16% | 5.41 | 5.27 | 5.59 | 5.64 |

Depending on the buffering capacity of the developer, the pH increase in the fixer may be smaller or greater. Ascorbic acid based developer solutions C and D are more buffered and therefore, the pH increase of the fixer is appreciably higher than in the case of developers A and B, which are hydroquinone based. Due to this effect, one would expect appearance of aluminum sludging and precipitation for developers C and D to a greater extent than for the developers A and B.

Example 4

Appearance of Aluminum Sludging Depending on the Developing Substance.

In this experiment, the appearance of aluminum sludge formation (haze, precipitation) was evaluated by making different mixtures of the oxidized developing solutions and fixer solution A. Mixtures were composed of 4, 8, 12, 16 and 20% of the respective developing solutions in mixtures with the fixer solution A. The mixtures were inspected visually immediately after mixing after 10 minutes, 1, 4, 16 and 24 hours respectively.

TABLE 4

| Developing solution | % of developer in mixture | Immediately after mixing | After 10 min | After 1 hour | After 4 hours | After 16 hours | After 24 hours |
|---|---|---|---|---|---|---|---|
| A(comp.) | 4 | + | + | + | + | + | + |
| | 8 | + | + | + | + | + | + |
| | 12 | + | + | + | + | — | — |
| | 16 | — | — | — | — | — | — |
| | 20 | — | — | — | — | — | — |
| B(comp.) | 4 | + | + | + | + | + | + |
| | 8 | + | — | — | — | — | — |
| | 12 | + | — | — | — | — | — |
| | 16 | — | — | — | — | — | — |
| | 20 | — | — | — | — | — | — |
| C(inv.) | 4 | + | + | + | + | + | + |
| | 8 | + | + | + | + | + | + |
| | 12 | + | + | + | + | + | + |
| | 16 | + | + | + | + | + | + |
| | 20 | + | + | + | + | + | + |
| D(inv.) | 4 | + | + | + | + | + | + |
| | 8 | + | + | + | + | + | + |
| | 12 | + | + | + | + | + | + |
| | 16 | + | + | + | + | + | + |
| | 20 | + | + | + | + | + | + |

In the Table 4 hereinbefore, the observed data about occurrence or appearance of haze and precipitation have been summarized ("+" means absence of haze (cloudiness) and/or precipitation, "−" means presence of haze and precipitation).

It was found that the use of an ascorbic acid based developer prevents the formation of aluminum sludge in the fixer. In this example, it is even realized despite the increased buffering capacities of the ascorbic acid developers used.

Example 5

Difference Between Fresh and Oxidized Developer Solutions.

In order to demonstrate the difference between fresh and oxidized developer solutions, 20% mixtures by volume of the respective developers were made. For each of the developers, two mixtures were made: one containing the fresh developer and one containing the oxidized developer solution. Following table shows the visual results with respect to formation of aluminum sludge. "+" means the absence of sludge, "−" indicates the presence of sludge (haze (cloudiness) and or precipitates). The time refers to the time after mixing of the developing and the fixing solution.

TABLE 5

| Developing solution | fresh or oxid. devel. | Immediately after mixing | After 10 min | After 1 hour | After 4 hours | After 16 hours | After 24 hours |
|---|---|---|---|---|---|---|---|
| A (comp.) | fresh | — | — | — | — | — | — |
| | oxid. | — | — | — | — | — | — |
| B (comp.) | fresh | + | — | — | — | — | — |
| | oxid. | — | — | — | — | — | — |
| C (inv.) | fresh | + | — | — | — | — | — |
| | oxid. | + | + | + | + | + | + |
| D (inv.) | fresh | + | — | — | — | — | — |
| | oxid. | + | + | + | + | + | + |

Results summarized in Table 5 illustrate that in developers based on hydroquinone as a developing agent, sludge formation in the fixer independently occurs on the oxidation of the developing solution. Fresh ascorbic acid developers hardly show any improvement in the sludging properties. In practice however carried over developer is oxidized and only the data for the oxidized developer are relevant to the processing situation in practice (being in a running equilibrium state).

Only at the very start of the processing cycle in the processor (after a new start, e.g., after cleaning of the processor) fresh developer is carried over to the fixer. In these cirumstances however, there is usually no sludge (fresh developer has a lower pH, sludging is a time effect).

Example 6

The experiments were performed using a slightly modified Curix 60 automatic developing machine (trademarked product from Agfa Gevaert), using CURIX Ortho HTH film (also trademarked product from Agfa-Gevaert) exposed up to 30% of the total film surface. The developing solutions A and D and the fixing solution A were used. The experiments were performed at standard replenishment rates of 600 ml/m$^2$ for the developer. The experiment was performed in one case making use of the standard replenishment rate for the fixer (750 ml/m$^2$) and in the other case without replenishment of the fixer.

In each experiment 5,25 m$^2$ of film was processed in 5 blocks of 1,05 m$^2$. After each block of 1.05 m$^2$ of processing, the fixer solution was visually inspected and the pH of the fixing solution was measured.

In the results summarized in the Table 6 "+" means absence of aluminum sludging in the fixer, "−" indicates sludge formation.

As becomes clear from the Table 6 hereinafter at standard replenishing rates of the fixer, there is no aluminum sludging in the fixer, since there is hardly a pH increase.

At decreased replenisher rates, there is no sludge formation when developer D is used. When a hydroquinone based developer is used, sludge occurs after 4 m$^2$ of film have been processed in 1 l of fixer (equivalent regeneration 250 ml/m$^2$).

The seasoned fixer when using developer D moreover clearly shows less unagreable smell or odor than the seasoned fixer used in combination with developer A comprising hydroquinone as a developing agent.

TABLE 6

| Standard replenish. | m$^2$ | 0 | 1.05 | 2.1 | 3.15 | 4.2 | 5.25 |
|---|---|---|---|---|---|---|---|
| A | sludge | + | + | + | + | + | + |
| | pH | 4.62 | 4.63 | 4.65 | 4.67 | 4.68 | 4.69 |
| D | sludge | + | + | + | + | + | + |
| | pH | 4.62 | 4.64 | 4.66 | 4.69 | 4.71 | 4.73 |
| No regeneration | m$^2$ | 0 | 1.05 | 2.1 | 3.15 | 4.2 | 5.25 |
| A | sludge | + | + | + | + | — | — |
| | pH | 4.66 | 4.70 | 4.81 | 4.95 | 5.06 | 5.21 |
| D | sludge | + | + | + | + | + | + |
| | pH | 4.66 | 4.71 | 4.85 | 5.00 | 5.18 | 5.38 |

Example 7

Processing of a Silver Halide Material Having Emulsion Grains Rich in Silver Chloride.

This example demonstrates the advantages in the context of rapid processing methods according to the present invention, especially for emulsions comprising tabular AgCl (I) crystals having {111} major planes.

The following solutions were prepared:

3 l of a dispersion medium (C) containing 0.444 moles of sodium chloride, 15 g of inert gelatin and 270 mg of adenine; temperature was established at 45° C. and pH was adjusted to a value of 5.5;

a 2.94 molar silver nitrate solution (A);

a solution containing 4.476 moles of sodium chloride, 0.0224 moles of potassium iodide and 420 mg of adenine (B1).

A nucleation step was performed by introducing solution A and solution B1 simultaneously in dispersion medium C both at a flow rate of 30 ml/min during 30 seconds. After a physical ripening time of 15 min. during which the temperature was raised to 70° C. and 97.5 g of gelatin and 1500 ml of water were added and the mixture was stirred for an additional 5 minutes. Then a growth step was performed by introducing by a double jet during 66 minutes solution A starting at a flow rate of 7.5 ml/min and linearly increasing the flow rate to an end value of 37.5 ml/min, and solution B1 at an increasing flow rate in order to maintain a constant mV-value, measured by a silver electrode versus a saturated calomel electrode (S.C.E.), of +92 mV. For this emulsion an iodide content in the silver chloroiodide tabular crystals of 1.3 mole % was obtained by adding a further amount of 0.8 mole % of iodide at the end of the preparation stage.

To this dispersion medium an amount of 1.25 mmole per mole of silver chloride was added of the dye anhydro-5,5'-dichloro-3,3'-bis(n-sulfobutyl)-9)-ethyl-oxacarbocyanine hydroxide. After cooling to about 40° C. the pH value of the said dispersing medium was adjusted to a value of 3.0 with sulfuric acid, and after the addition of 55.5 ml of polystyrene sulphonic acid the obtained flocculate was decanted and washed three times with an amount of 6 l of demineralized water in order to remove the soluble salts present. The thus obtained silver chloride tabular emulsion showed following grain characteristics.

The average diameter "$d_{EM}$", average thickness "t", and average aspect ratio "AR" were obtained from electron microscopic photographs: the diameter of the grain was defined as the diameter of the circle having an area equal to the projected area of the grain as viewed in the said photographs. Moreover the average sphere equivalent diameter $d_{EM}$ obtained from the measurement of electric reduction currents obtained by reduction of a silver halide grain with a microscopically fine electrode is given: the sphere equivalent diameter was defined as the diameter of a hypothetical spherical grain with the same volume as the corresponding tabular grain. So a value for "dEM" of 1.27 μm, a value for "t" of 0.14 μm and for "AR" of 8.8 was found.

Before the start of the chemical ripening the mV-value of every emulsion was adjusted at +120 mV with sodium chloride and the pH value was adjusted at 5.5 with sodium hydroxide.

Ripening agents causing a different composition of the ripening solutions used were: tetramethyl seleno ureum as a source of selenium and sodium thiosulphate as a source of sulfur. Further chemical ripening agents were gold thiocyanate and toluene thiosulphonic acid was used as predigestion agent. Amounts of chemical ripening agents were optimized in order to obtain an optimal fog-sensitivity relationship after 2 hours at 57° C.

Before coating the emulsion was stabilized with 1-p-carboxy-phenyl-5-mercaptotetrazole and after addition of the normal coating additives the solutions were coated simultaneously together with a protective layer containing 1.3 g gelatin per $m^2$ per side on both sides of a polyethylene terephthalate film support having a thickness of 175 μm. The resulting photographic material was containing an amount of silver halide corresponding to 4.5 grams of $AgNO_3$ per $m^2$ and an amount of gelatin corresponding to 3.55 g/$m^2$ each expressed per side of the support. Samples of these coatings A, B and C were exposed with green light of 540 nm during 0.1 seconds using a continuous wedge.

Processing in the developer compositions A, B, C and D, followed by fixing without an intermediate rinsing step leads to the following sensitometric results.

The density as a function of the light dose was measured and therefrom were determined the following parameters:

fog level F (with an accuracy of 0.001 density), the relative speed S at a density of 1 above fog (an increase of the said speed with a factor of 2 gives a speed value that is 0.30 lower as the relation is logarithmic and as less light is needed to get the desired density), the contrast expressed as gradation G, calculated between the densities 0.25 and 2.0 above fog, the maximum density DMAX.

Results obtained for fog F, sensitivity S, contrast G and maximum density DMAX in Developer Compositions A, B, C and D respectively and are summarized in Table 7 hereinafter.

The specifications for a CURIX ORTHO film material, trade name product from Agfa-Gevaert, processed in its own common processing solutions (G138/G334, trademarked names of developer and fixer from Agfa-Gevaert) in a 90 seconds processing cycle are given as a reference.

TABLE 7

| Developer composition | F | S | G | DMAX |
|---|---|---|---|---|
| A (comp.) | 0.042 | 1.98 | 2.95 | 3.21 |
| B (comp.) | 0.066 | 1.67 | 3.50 | 3.47 |
| C (inv.) | 0.040 | 1.65 | 3.75 | 3.50 |
| D (inv.) | 0.040 | 1.69 | 3.72 | 3.40 |
| CURIX ORTHO | 0.030 | 1.67 | 2.87 | 3.51 |

It is clear that for the developer compositions C and D used in the method according to the present invention the most favourable relationship between fog, sensitivity and gradation is obtained.

It has thus been demonstrated in this Example that even for short processing times of 45 seconds a suitable sensitometry can be obtained, even with radiographic film materials coated from emulsions having tabular {111} silver chloroiodide crystals as in image-forming system of the present invention.

Having described in detail preferred embodiments of the current invention, it will now be apparent to those skilled in the art that numerous modifications can be made therein without departing from the scope of the invention as defined in the following claims.

What is claimed is:

1. Method of processing an exposed black-and-white silver halide light-sensitive photographic material comprising developing in a developer solution, followed by fixing in a fixer solution, said fixer solution comprising a hardening agent and buffering compounds in a concentration of from 0.2 to 0.8 mole per liter, said fixer solution being free of an α-ketocarboxylic acid compound and any boron compound, and wherein, in running equilibrium conditions, said fixer solution has a pH of from 4.6 to 5.5, further adding to said fixer a fixer replenisher at a rate of from 0 ml/$m^2$ up to 300 ml/$m^2$; said fixing followed by rinsing and drying, wherein rinsing between developing and fixing is excluded;

wherein a compound having an α-ketocarboxylic acid structure in an amount from 0 to 3 g per liter is present in the said fixer replenisher, characterized in that said developing is performed in a developer comprising, in an amount of from 5 g up to 100 g per liter, a developing agent corresponding to formula (I), a precursor and/or a metal salt thereof (I)

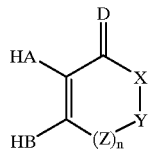

wherein in the formula (I) each of A, B and D independently represents an oxygen atom or $NR^1$;

X represents an oxygen atom, a sulfur atom, $NR^2$; $CR^3R^4$; C═O; C═$NR^5$ or C═S;

Y represents an oxygen atom, a sulfur atom, $NR'^2$; $CR'^3R'^4$; C═O; C═$NR'^5$ or C═S;

Z represents an oxygen atom, a sulfur atom, $NR''^2$; $CR''^3R''^4$; C═O; C═$NR''^5$ or C═S;

n equals 0, 1 or 2;

each of $R^1$ to $R^5$, $R'^2$ to $R'^5$ and $R''^2$ to $R''^5$ independently represents hydrogen, alkyl, aralykyl, hydroxyalkyl, carboxyalkyl, alkenyl, alkynyl, cycloalkyl, cycloalkenyl, aryl or heterocyclyl; and wherein $R^3$ and $R^4$, $R'^3$ and $R'^4$, $R''^3$ and $R''^4$, may further form a ring together; and wherein in the case that $X=CR^3R^4$ and $Y=CR'^3CR'^4$, $R^3$ and $R'^3$ and/or $R^4$ and $R'^4$ may form a ring and in the case that $Y=CR'^3R'^4$ and $Z=CR''^3CR''^4$ with n=1 or 2, $R^3$ and $R'^3$ and/or $R^4$ and $R'^4$ may form a ring.

2. Method according to claim 1, wherein in the formula (I) A, B and X each represent an oxygen atom; n=0,; $Y=CH—(CHOH)_m—CH_2—R^6$ wherein m=1, 2, 3 or 4, and wherein $R^6$ represents OH for m=1; H or OH for m=2, 3 or 4.

3. Method according to claim 1, wherein in the formula (I) A and B each represent an oxygen atom; n=0 and each of X and Y represent $C(CH_3)_2$.

4. Method according to claim 1, wherein said developer is substantially free from any polyhydroxybenzene compound.

5. Method according to claim 1, wherein said developer is free from any hardening agent.

6. Method according to claim 1, wherein said hardening agent in the fixer is a compound providing aluminum ions.

7. Method according to claim 1, wherein said developer solution is free from any boron compound.

8. Method according to claim 1, wherein pH in said developer solution is buffered between a value of from 9.0 up to 11.0 by buffering compounds having a concentration of from 0.3 up to 1.0 mole/liter.

9. Method according to claim 1, wherein pH in said fixer solution in running equilibrium conditions is between a value of from 4.8 up to 5.3.

10. Method according to claim 1, further adding to said developer a developer replenisher at a rate of from 50 $ml/m^2$ up to 300 $ml/m^2$.

11. Method according to claim 1, further adding to said fixer a fixer replenisher at a rate of from 50 $ml/m^2$ up to 250 $ml/m^2$.

12. Method according to claim 1, wherein said processing proceeds in a total processing time of from 35 up to 75 seconds.

13. Method according to claim 1, wherein said material is composed of at least one light-sensitive silver halide emulsion layer comprising emulsion crystals rich in silver chloride.

14. Method according to claim 13, wherein said emulsion crystals rich in silver chloride are cubic or {111} or {100} tabular crystals.

15. Method according to claim 1, wherein said material is an X-ray film material.

* * * * *

UNITED STATES PATENT AND TRADEMARK OFFICE

CERTIFICATE OF CORRECTION

PATENT NO. : 6,083,672

DATED : July 4, 2000

INVENTOR(S) : André Roefs et al

It is certified that error appears in the above-indentified patent and that said Letters Patent is hereby corrected as shown below:

On title page, insert the following
-- [60] Related U.S. Application Data
Provisional Application No. 60/070,428, January 5, 1998 --.

Column 2, line 26, "a toms" should read -- atoms --.

Column 4, line 7, "o f" should read -- of --.

Column 6, line 37, "$Ra^3$" should read -- $R''^3$ --.

Column 6, bridging lines 44 and 45, "$Y=CH13(CHOH)_m-CH_2-R^6$" should read -- $Y=CH-(CHOH)_m-CH_2-R^6$ --.

Column 8, line 60, "Previously" should read -- previously --.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*